US006443726B2

(12) United States Patent
Atemboski et al.

(10) Patent No.: US 6,443,726 B2
(45) Date of Patent: Sep. 3, 2002

(54) BURNER ASSEMBLY FOR A GAS-BURNING FIREPLACE

(75) Inventors: Alan R. Atemboski, Renton; Leslie E. King, Monroe; Kurt W. F. Rumens, Kirkland, all of WA (US)

(73) Assignee: Travis Industries, Inc., Kirkland, WA (US)

( * ) Notice: Subject to any disclaimer, the term of this patent is extended or adjusted under 35 U.S.C. 154(b) by 0 days.

(21) Appl. No.: 09/788,279

(22) Filed: Feb. 15, 2001

Related U.S. Application Data

(60) Provisional application No. 60/182,579, filed on Feb. 15, 2000.

(51) Int. Cl.[7] ..... F23Q 2/32; F24C 3/00

(52) U.S. Cl. ..... 431/125; 126/512; 126/92 R; 126/92 AC; 431/328

(58) Field of Search ..... 126/512, 92 R, 126/92 AC, 91 R, 85 R, 85 B; 431/125, 126, 328, 326

(56) References Cited

U.S. PATENT DOCUMENTS

| | | | | |
|---|---|---|---|---|
| 1,156,735 A | | 10/1915 | Wilson | |
| 1,216,848 A | | 2/1917 | Schmidt | |
| 1,286,108 A | | 11/1918 | Richards | |
| 2,671,440 A | | 3/1954 | Dupler | |
| 3,042,109 A | | 7/1962 | Peterson | |
| 3,993,430 A | | 11/1976 | Forker | |
| 4,061,133 A | | 12/1977 | Swain | |
| 4,194,489 A | | 3/1980 | Swain | |
| 4,726,351 A | * | 2/1988 | Whittaker et al. | 126/512 |
| 4,869,664 A | | 9/1989 | Wright et al. | |
| 4,875,464 A | | 10/1989 | Shimek et al. | |
| 5,000,162 A | | 3/1991 | Shimek et al. | |
| 5,081,981 A | | 1/1992 | Beal | |
| 5,320,520 A | | 6/1994 | Barth et al. | |
| 5,328,356 A | | 7/1994 | Hawkinson | |
| 5,429,495 A | | 7/1995 | Shimek et al. | |
| 5,601,073 A | | 2/1997 | Shimek | |
| 5,655,513 A | | 8/1997 | Whitfield | |
| 5,890,485 A | * | 4/1999 | Shimek et al. | 431/125 |
| 5,941,237 A | | 8/1999 | Shimek et al. | |
| 5,996,575 A | | 12/1999 | Shimek et al. | |
| 6,006,743 A | * | 12/1999 | Shimek et al. | 126/512 |
| 6,053,165 A | | 4/2000 | Butler et al. | |

FOREIGN PATENT DOCUMENTS

| | | | | |
|---|---|---|---|---|
| EP | 0194157 | * | 9/1986 | 126/512 |
| FR | 2 629 178 A1 | | 9/1989 | |
| GB | 429115 | | 5/1935 | |
| GB | 2068106 | * | 8/1981 | 126/512 |
| GB | 2 179 438 A | | 3/1987 | |

OTHER PUBLICATIONS

Johnson Gas Appliance Company, Mendota Division, company literature regarding "Heat Producing Gas Fireplace Insert." (undated).

Johnson Gas Appliance Company, Mendota Division, "Mendota Hearth" product brochure regarding Mendota Hearth inserts and fireplaces (undated).

* cited by examiner

*Primary Examiner*—James C. Yeung
(74) *Attorney, Agent, or Firm*—Perkins Coie LLP

(57) ABSTRACT

A burner assembly that overcomes problems experienced in the prior art. One embodiment provides a burner assembly for burning a fuel gas from a gas source. The assembly has a burner body with a contoured upper surface and a burner pan with a gas inlet aperture therein. The burner body is connected to the burner pan. The burner body and burner pan are spaced apart to form a gas distribution chamber therebetween. The burner body has a plurality of gas apertures extending between the distribution chamber to an upper surface of the burner body. The gas apertures are positioned to allow the fuel gas to flow to selected areas on the burner body's upper surface for combustion to create a desired flame at selected locations relative to the upper surface. In one embodiment is a contoured upper surface with a plurality of peaks and valleys forming simulated coal or ember members.

32 Claims, 12 Drawing Sheets

BURNER ASSEMBLY FOR A GAS-BURNING FIREPLACE

CROSS-REFERENCE TO RELATED APPLICATIONS

The present application is a non-provisional patent application claiming priority to U.S. Provisional Patent Application No. 60/182,579, titled "Burner Assembly for a Gas-Burning Fireplace," filed Feb. 15, 2000, and which is incorporated herein by reference.

TECHNICAL FIELD

The present invention is directed toward apparatus for gas-burning fireplaces, stoves, and fireplace inserts, and more particularly toward burner assemblies for the gas-burning fireplaces, stoves, and fireplace inserts.

BACKGROUND OF THE INVENTION

Natural gas or other combustible gases are typically used as a fuel gas for gas-burning fireplaces, stoves, or inserts. The fuel gas typically burns with a blue flame, unless the flame is modified to have an orange color similar to the flame color in a natural wood-burning fire. Many devices have been developed for use with gas-burning fireplaces, stoves, or inserts to provide a desired fuel gas/air mixture. The devices also provide a selected flow rate of the fuel gas to allow for combustion in a manner that simulates a natural wood-burning fire having the orange, flickering flames, burning logs, and glowing embers. A natural wood-burning fire is very aesthetically pleasing, although real wood-burning fires are often not feasible in many residential settings. Achieving a gas-burning fire that very closely resembles the look of a natural wood-burning fire is very difficult, and is highly desirable.

SUMMARY

The present invention provides a burner assembly that overcomes problems experienced in the prior art. One embodiment provides a burner assembly for burning a fuel gas from a gas source. The assembly has a non-metallic burner body with a contoured upper surface adapted to simulate glowing embers, coal, or other portions of a natural wood-burning fire as the fuel gas burns in a fireplace. The burner assembly includes a burner pan with a gas inlet aperture therein, and a non-metallic burner body is connected to the burner pan. The burner body has a gas distribution chamber formed integrally therein with an opening formed in a lower portion of the burner body. The burner body's lower portion is releasably connected to the burner pan, so the burner pan covers the opening in the distribution chamber.

The distribution chamber has a first chamber portion that communicates with the gas inlet aperture in the burner pan to receive a flow of fuel gas. A second chamber portion is connected to the first chamber portion by a narrowed gas flow orifice portion positioned between the first and second chamber portions. The orifice portion is selectively sized to control the flow of fuel gas from the first chamber portion to the second chamber portion.

The burner body has a plurality of gas apertures extending between the distribution chamber to an upper surface of the burner body. The gas apertures are positioned relative to the first and second chamber portions and the intermediate orifice portion to allow the fuel gas to flow to selected areas on the burner body's upper surface for combustion to create a desired flame at selected locations relative to the upper surface. The gas aperture provides the fuel gas to the upper surface, for example, around and under simulated log members positioned on the burner body's upper surface.

The burner body's upper surface in one embodiment is a contoured upper surface with a plurality of peaks and valleys forming simulated coal or ember members. The contoured upper surface forms a support portion to support simulated log members or the like at desired positions relative to the gas apertures. The gas apertures open at the contoured upper surface in the peaks and valleys, so the plurality of gas distribution apertures have different heights and provide selected fuel gas distribution of the contoured upper surface for combustion. The burner body of one embodiment is constructed of a ceramic-based material that allows portions of the contoured upper surface glow with various colorations as the fuel gas burns, thereby simulating burning and glowing embers in the base of a natural wood-burning fire. In an alternate embodiment, the burner body's contoured upper surface is shaped to provide other aesthetic appearances simulating a configuration of a natural wood-burning fire.

In another embodiment, the burner assembly includes a burner pan with a base and a projection extending away from the base. The base has a gas inlet aperture extending therethrough. A burner body has upper and lower portions. The lower portion of the burner body being connectable to the burner pan in a position to form a gas distribution chamber therebetween and in fluid communication with the gas inlet aperture. The upper portion of the burner body having a contoured surface with a plurality of peaks and valleys. The burner body has a plurality of gas distribution apertures extending from the lower portion to the contoured surface. The gas distribution apertures are positioned to direct a flow of the fuel gas to the contoured upper surface for ignition. The lower portion of the burner body has an elongated channel therein sized to receive the burner pan's projection when the burner pan is connected to the burner body. The channel is positioned to define at least a portion of the gas distribution chamber for distribution of the fuel gas to the gas distribution apertures.

DETAILED DESCRIPTION OF THE INVENTION

Figure 1:
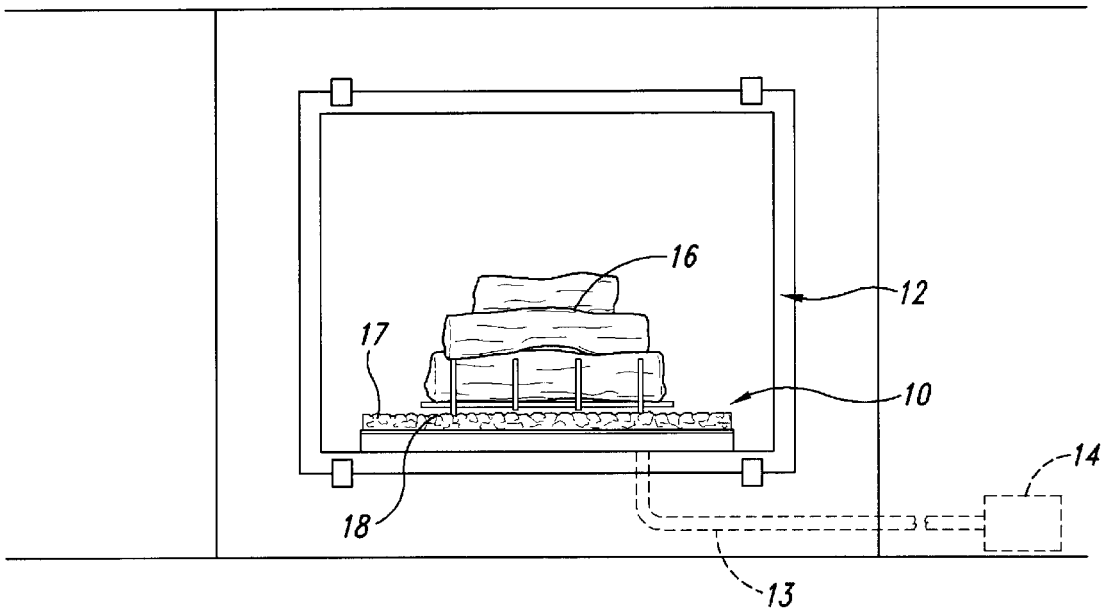
FIG. 1 is a front elevational view of a gas-burning fireplace insert with a burner assembly in accordance with an embodiment of the present invention.

A burner assembly 10 in accordance with an illustrative embodiment of the present invention is shown in the FIG. 1 within a gas-burning fireplace insert 12. The burner assembly 10 is connected to a gas line 13 that, in turn, connects to a gas source 14 to provide a flow of fuel gas to the burner assembly. The burner assembly 10 is configured to support a plurality of simulated logs 16 stacked to simulate wood in a natural wood-burning fire. The burner assembly 10 directs the flow of fuel gas received from the gas source 14 to the surface of the burner assembly and around the simulated logs 16. When the fuel gas is ignited at the upper surface 17 of the burner assembly 10, the burning gas acts with the burner assembly and the simulated logs 16 to provide a fire in the fireplace insert 12 that looks like a natural wood-burning fire.

The burner assembly 10 in the illustrated embodiment is also configured to provide a simulated bed of glowing embers 18 underneath the stack of simulated logs 16 as the fire is burning. The burner assembly 10 is also configured to distribute the fuel gas at selected rates and volumes over the burner assembly's upper surface 17 and around the simulated logs 16 to provide a flame having a generally orange coloration that flickers and "dances" around the simulated logs similar to the flames of a natural wood-burning fire.

Figure 2:
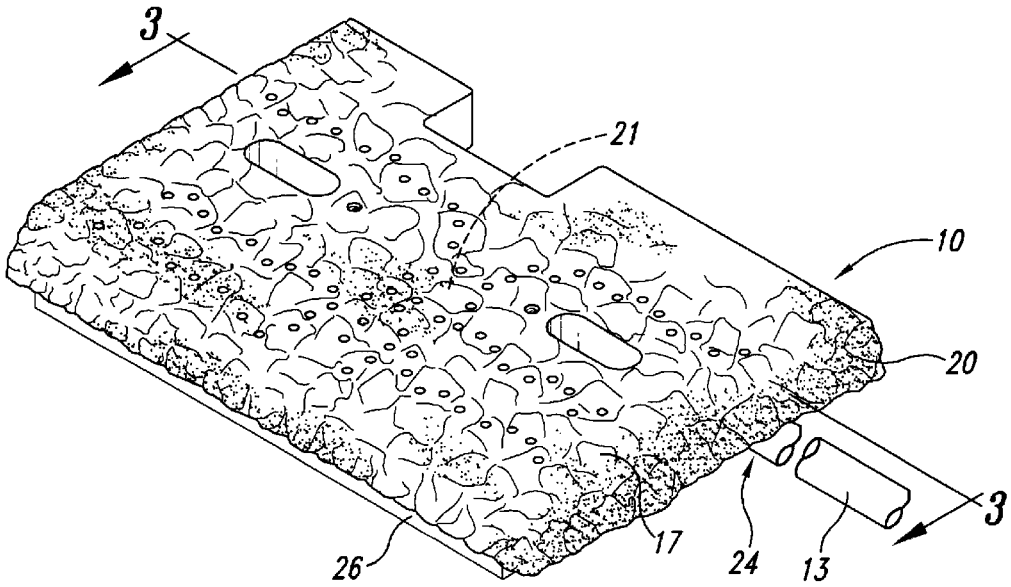
FIG. 2 is an enlarged top isometric view of the burner assembly of FIG. 1.
Figure 3:
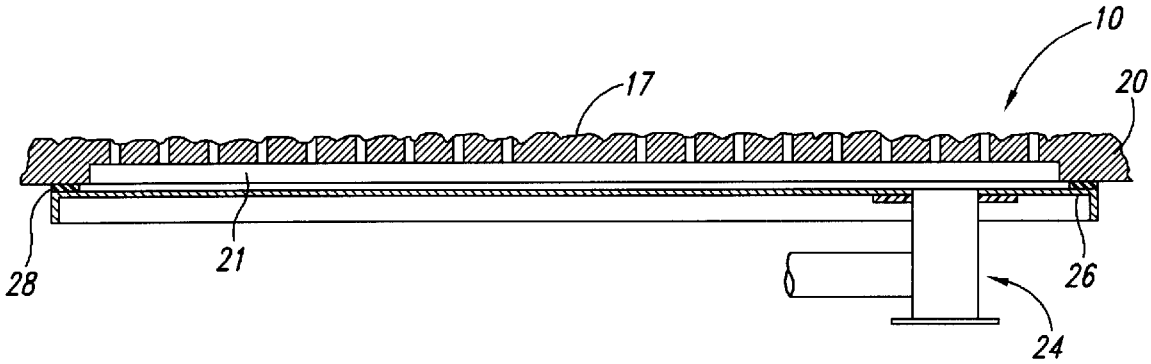
FIG. 3 is an enlarged cross-sectional view taken substantially along line 3—3 of FIG. 2.
Figure 4:
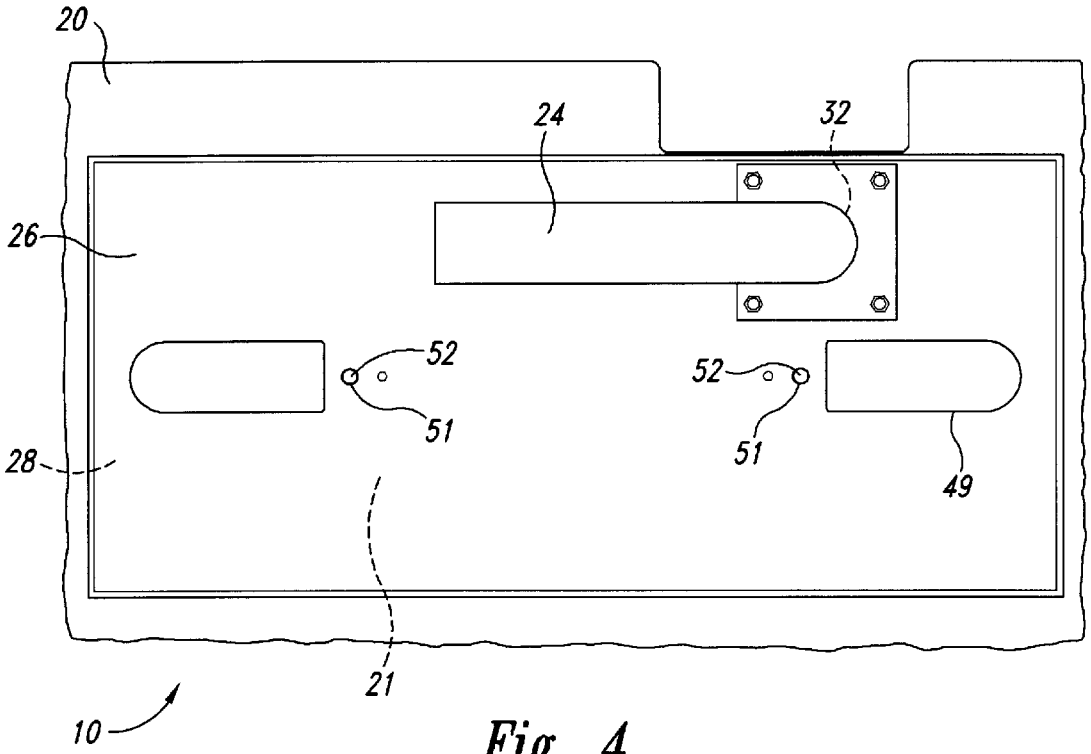
FIG. 4 is a bottom plan view of the burner assembly of FIG. 2 showing a burner pan and attached to the bottom of the burner body.

As best seen in FIGS. 2–4, the burning assembly 10 has a non-metallic burner body 20 that forms the upper portion of the burner assembly, and a burner pan 26 is connected to the bottom of the burner body. The burner assembly 10 connects to the gas line 13 (FIG. 3) with a mixing tube assembly 24 connected to the bottom of the burner pan 26. Accordingly, the fuel gas is provided via the gas line 13 (FIG. 2), through the mixing tube assembly 24, to the burner body 20. The burner body 20 has an interior chamber 21 integrally formed therein that receives the fuel gas from the mixing tube assembly 24. As discussed in greater detail below, the interior chamber 21 forms an integral gas distribution manifold that directs the fuel gas through the burner body 20 to the burner body's upper surface 17 for ignition into a flame. The burner pan 26, when installed on the burner body 20, extends over the interior chamber 21 so as to close out the interior chamber's lower side, and to allow access to the interior chamber when the burner pan is removed from the burner body. A gasket 28 (FIG. 3) is sandwiched between the burner pan 26 and the burner body 20 to form a seal around the interior chamber 21 that prevents leakage of the fuel gas from the interior chamber.

Figure 5:
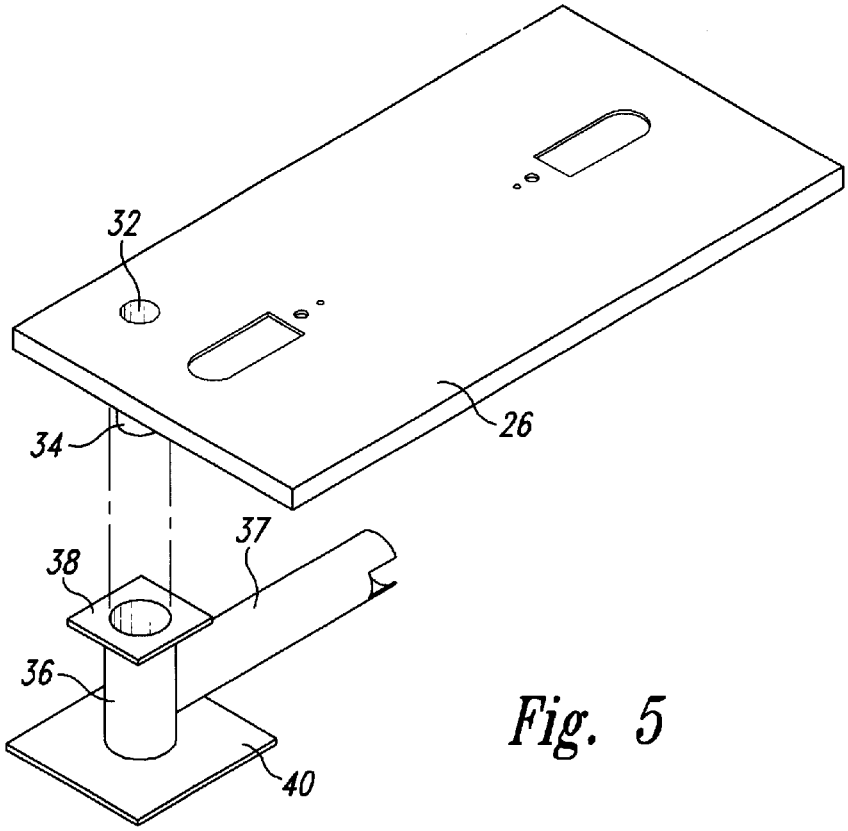
FIG. 5 is an enlarged partially exploded isometric view of a burner pan and mixing tube assembly of the burner assembly of FIG. 1 with a burner body not shown for purposes of clarity.

As best seen in FIG. 5, the burner pan 26 is a substantially flat metal plate having a gas inlet aperture 32, and the mixing tube assembly 24 connects to the burner pan 26 at the gas inlet aperture. The mixing tube assembly 24 is a conventional assembly having an inner mixing tube 34 secured to the burner pan 26. The inner mixing tube 34 extends into an outer mixing tube 36 having an upper flange 38 and a lower fire box flange 40 (FIG. 5). The upper flange 38 is rigidly connected to be burner pan 26 about the gas inlet aperture 32, and the fire box flange 40 engages the fire box of the fireplace insert 12 (FIG. 1). The mixing tube assembly 24 also includes a horizontal mixing tube 37 connected at one end to the outer mixing tube 36 and at the other end to the gas line 13, shown in FIG. 5 in phantom lines. The mixing tube assembly 24 is configured to allow a selected amount of air to mix with fuel gas in a conventional manner before the mixture passes through the gas inlet aperture 32 into the burner body's interior chamber 21 (FIG. 4).

Figure 6:
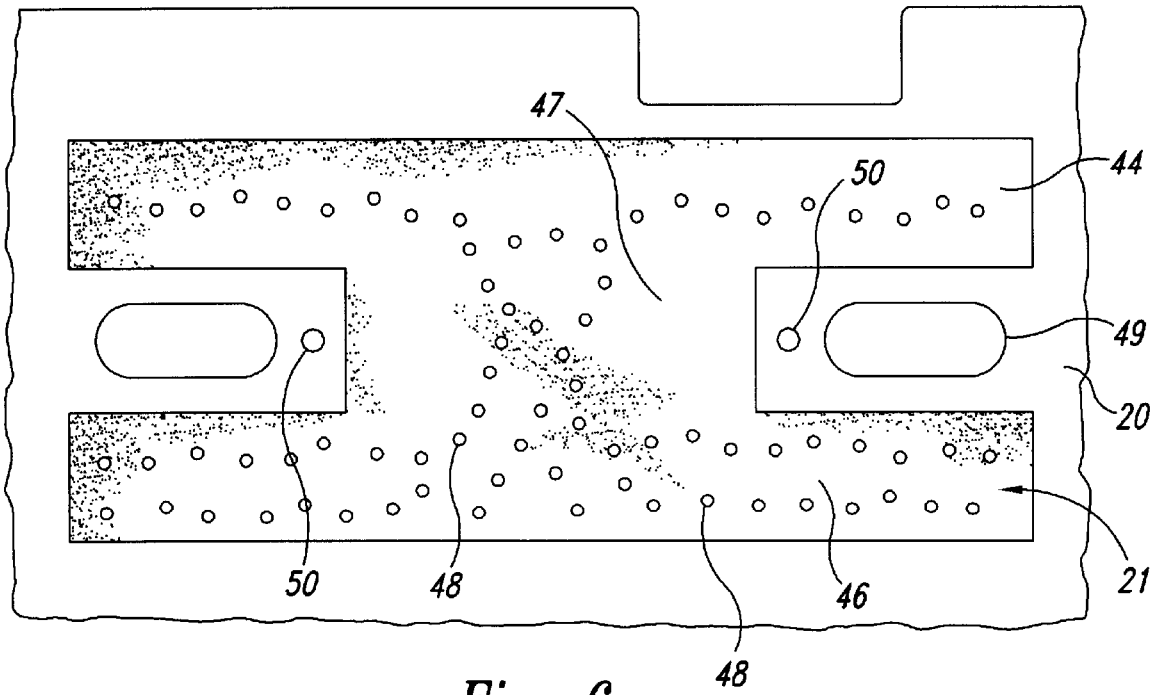
FIG. 6 is a bottom of plan view of the burner body of FIG. 2 shown removed from the burner pan.

As best seen in FIG. 6, the burner body's interior chamber 21 communicates with a plurality of burner apertures 48 extending through the top portion of the burner body 20. The interior chamber 21 of the illustrated embodiment has a generally "H" shape with an enlarged rear chamber portion 44 and an enlarged front chamber portion 46 connected by a narrowed intermediate chamber portion 47. The rear chamber portion 44 is positioned so it is immediately adjacent to the burner pan's gas inlet aperture 32 (FIG. 5) so the rear chamber portion receives the fuel gas from the mixing tube assembly 24 (FIG. 5). The rear chamber portion 44, intermediate chamber portion 47, and front chamber portion 46 are selectively sized to control the distribution of fuel gas between the rear and front chamber portions, such that the intermediate chamber portion acts as an orificing portion of the chamber. The shape, size and configuration of the front, rear, and intermediate chamber portions 46, 44, and 47, and the burner apertures 48 also maintain a desired gas pressure within the interior chamber during use, thereby controlling the flow rate of the fuel gas through the burner apertures.

In one embodiment, additional structure is provided in the intermediate chamber portion 47 to reduce the open area of the intermediate chamber portion and to provide additional restriction of the gas distribution to the front chamber portion 46. Accordingly, the gas pressure in the front chamber portion 46 can be reduced and the flow rate of fuel gas through the burner apertures 48 in the burner body's front portion is reduced. This reduced flow rate of fuel gas can provide a smaller flame that can be combined with other adjacent flames to produce a low flame over the burner body's upper surface to give the desired aesthetic appearance of the fire in the fireplace insert 12 (FIG. 1).

The burner pan 26 (FIG. 4) and the burner body 20 include a pair of combustion air holes 49 extending therethrough. The combustion air holes 49 are spaced apart from the interior chamber 21. Accordingly, air is drawn through the combustion air holes 49 and provided to the burner body's upper surface to facilitate combustion of the fuel gas over the burner body 20. The gasket 28 is shaped and sized to provide a seal around the combustion air holes 49 between the burner body 20 and the burner pan 26 to prevent air from leaking from the combustion air holes into the interior chamber 21 and changing the air/fuel mixture provided by the mixing tube assembly 24.

Figure 7:
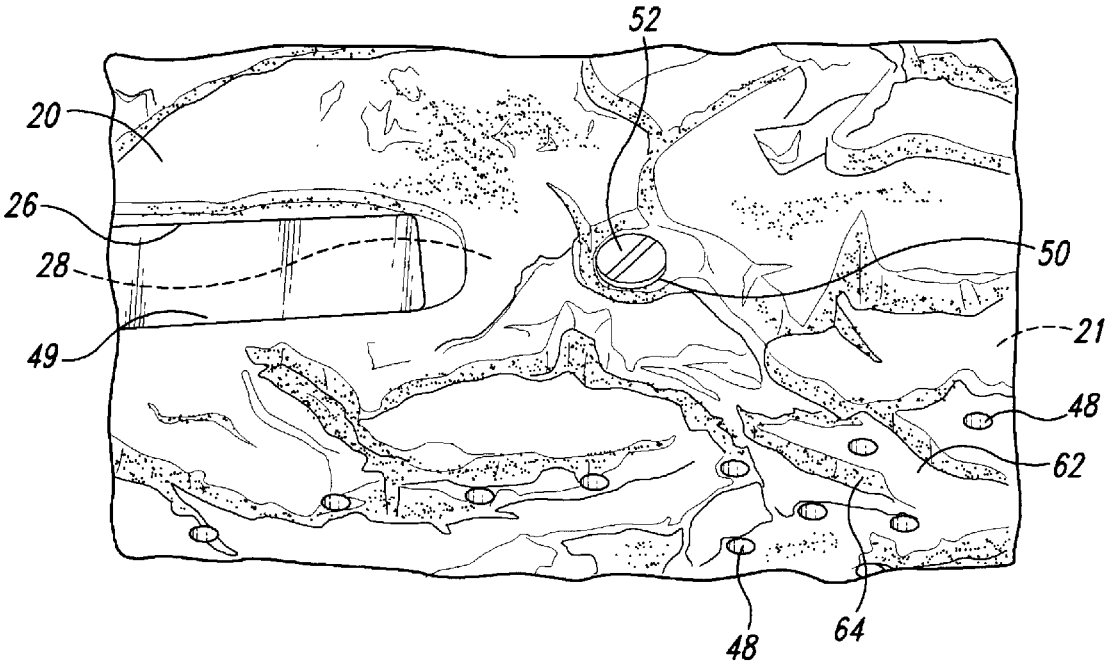
FIG. 7 is a top plan view of the burner assembly of FIG. 2 showing a contoured upper surface of a non-metallic burner body.

As best seen in FIGS. 6 and 7, the burner body 20 has a pair of fastener apertures 50 (FIG. 6) that coaxially align with fastener apertures 51 (FIG. 7) in the burner pan 26. A pair of screws 52 extend through the fastener apertures 50, 51 and securely retain the burner body 20 to the burner pan 26 and sandwich the gasket 28 in place to form a seal around the interior chamber 21. Alternate embodiments can use other fastening mechanisms to securely retain the burner body 20 and burner pan 26 together to maintain a seal around the interior chamber 21.

In an alternate embodiment, the burner body 20 has an interior chamber 21 with a substantially rectangular shape, rather than an "H" shape. The rectangular interior chamber is positioned relative to the burner pan's gas inlet aperture 32 to selectively maintain a desired gas pressure in the interior chamber for a desired flow of the fuel gas through the burner apertures 48. Combustion air holes 49 are also provided through the burner body 20 and the burner pan 26 adjacent to the interior chamber 21, but out of fluid communication with the interior chamber. Accordingly, the combustion air does not mix with the gas/air mixture within the interior chamber 21.

Figure 8:
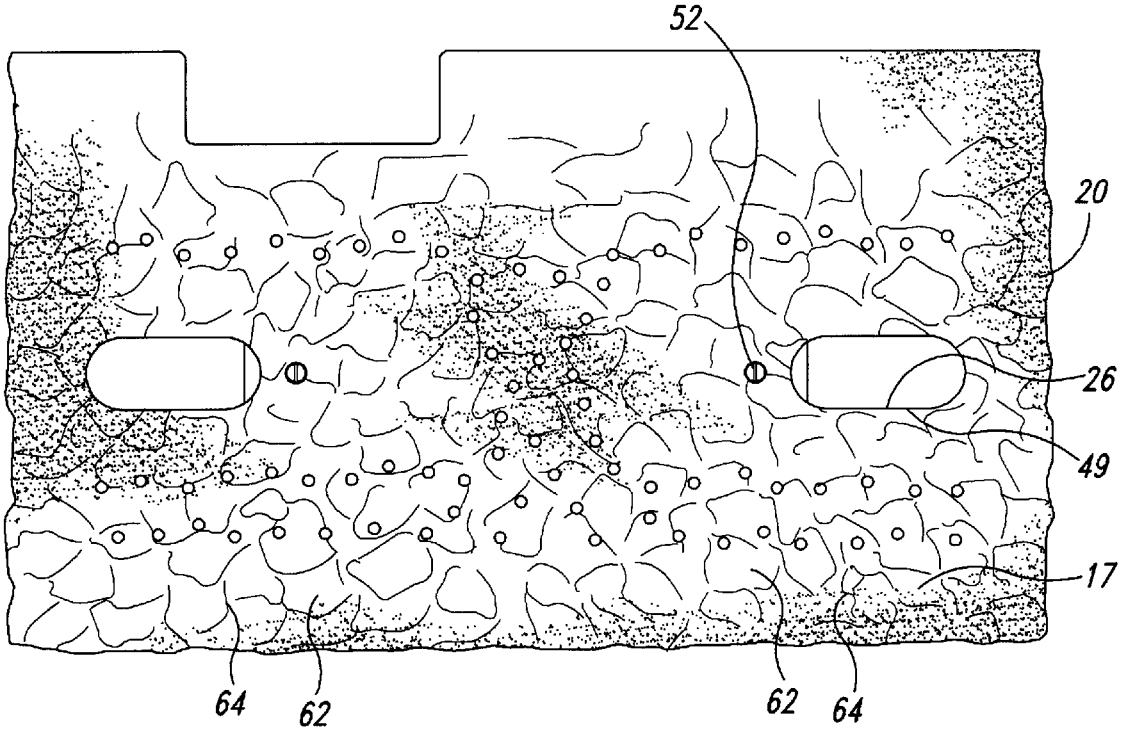
FIG. 8 is an enlarged plan view of the burner body of FIG. 4 shown fastened to the burner pan with a fastener.
Figure 9:
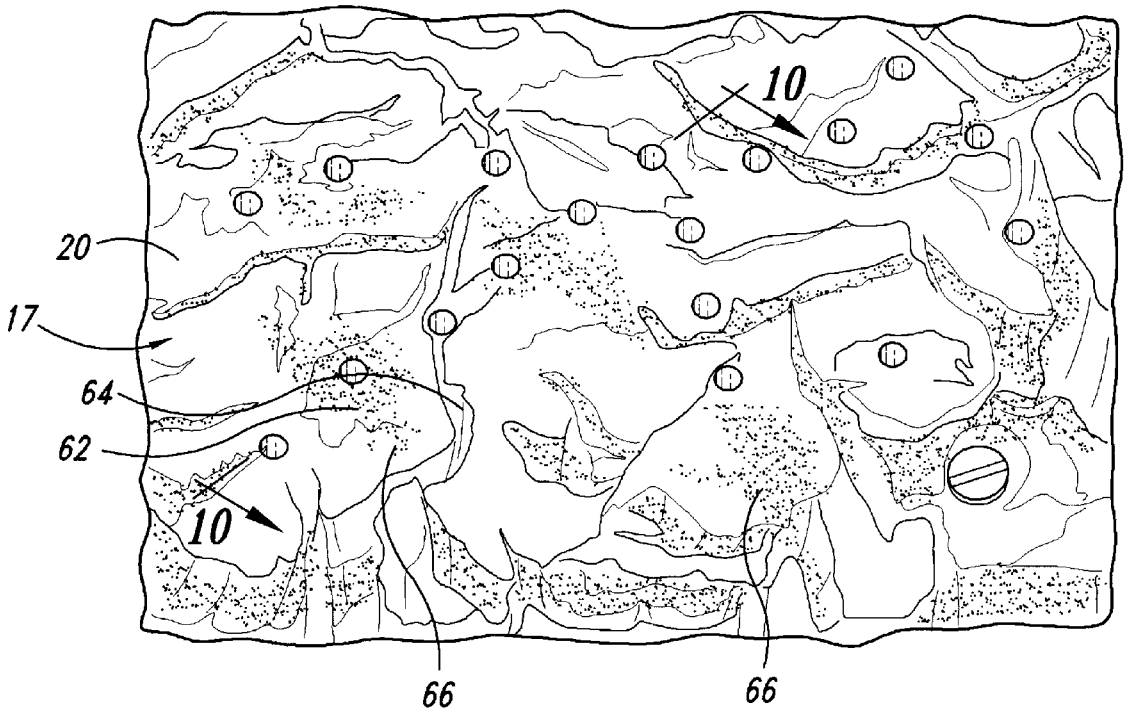
FIG. 9 is an enlarged top plan view of the burner body of FIG. 4 showing the contoured upper surface simulating coal pieces in an ember bed.

The burner body 20 in one embodiment is made of a ceramic-based material, such as a ceramic-fiber material, a ceramic refractory material, or the like. In the illustrated embodiment, the burner body 20 is a molded ceramic-fiber member, such as a DVS ceramic member, having an upper surface 17 that is highly contoured. As best seen in FIGS. 7, 8, and 9, the contoured upper surface 17 includes a plurality of peaks 62 and valleys 64 that form a plurality of simulated coal or ember members 66 having various selected sizes. The highly contoured upper surface 17 is also molded so the simulated ember members 66 have different sizes at different portions of the upper surface 17, such as the variety of ember sizes typically found in a natural wood-burning fire. The contoured upper surface 17 of the illustrated embodiment is molded to provide a larger number of small simulated ember members 66 along the front portion of the burner body 20. This front portion is the area highly visible to a person during use of the burner assembly 10 in the fireplace insert 12 (FIG. 1). The burner body's upper surface 17 has larger simulated ember members 66 toward the middle of the upper surface and the outer edge areas on the burner body's left and right sides. Alternate embodiments can have larger or smaller simulated ember members 66 molded into other selected areas of the burner body's upper surface 17 to provide the desired aesthetic appearance of a burning ember bed when the burner assembly is in use in the fireplace insert 12.

Figure 10:
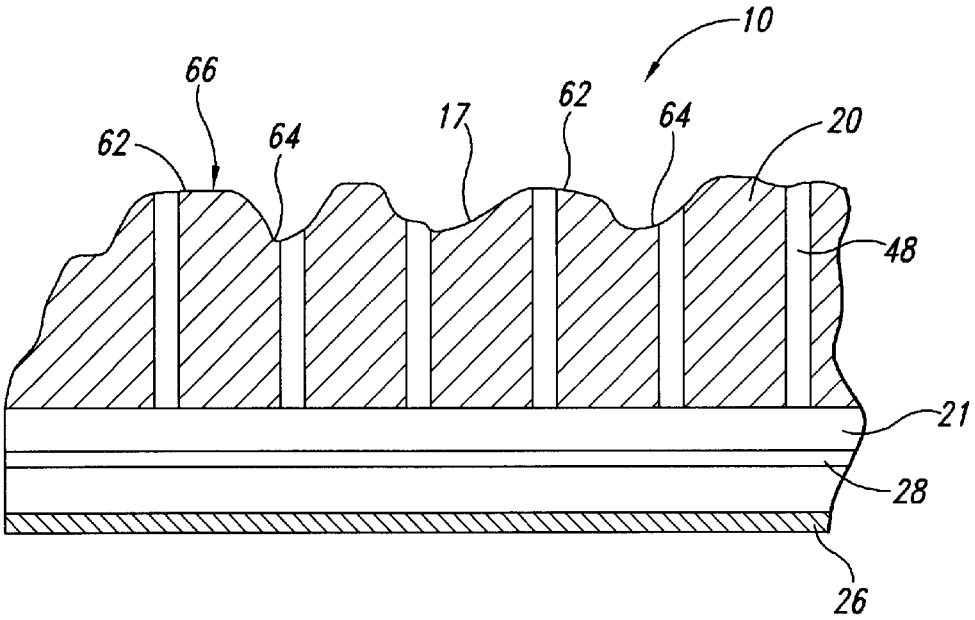
FIG. 10 is an enlarged cross-sectional view taken substantially along line 10—10 of FIG. 9 showing gas distribution apertures of varying heights in the burner body.
Figure 11:
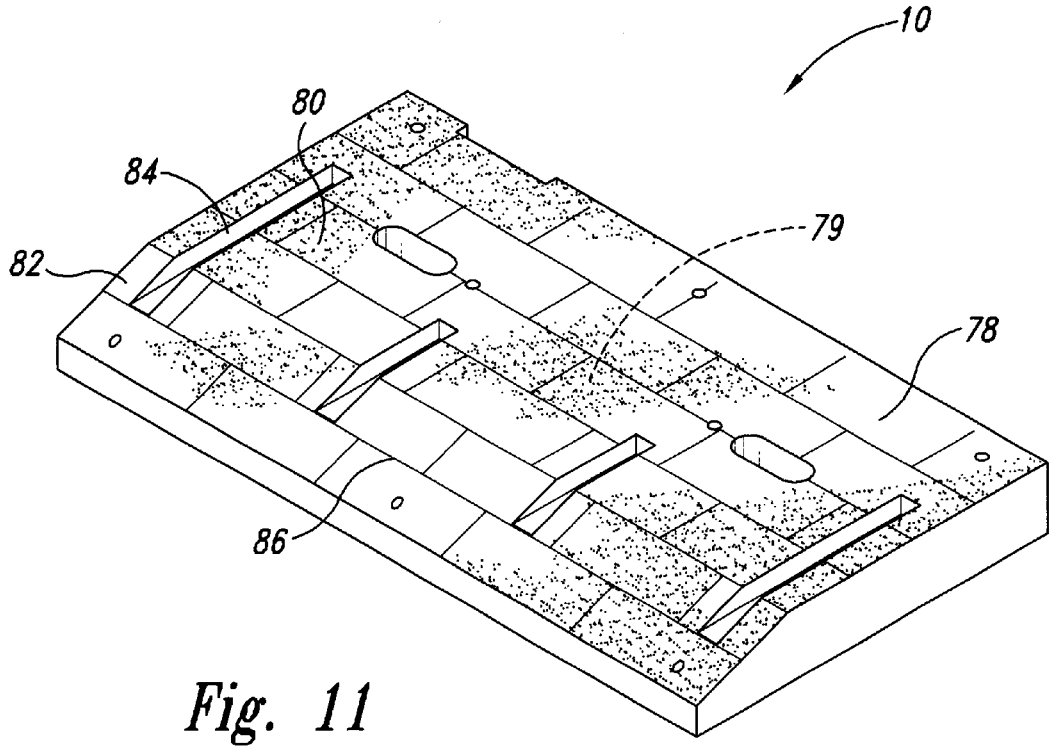
FIG. 11 is a top isometric view of a burner body of a burner assembly in accordance with an alternate embodiment of the present invention.
Figure 12:
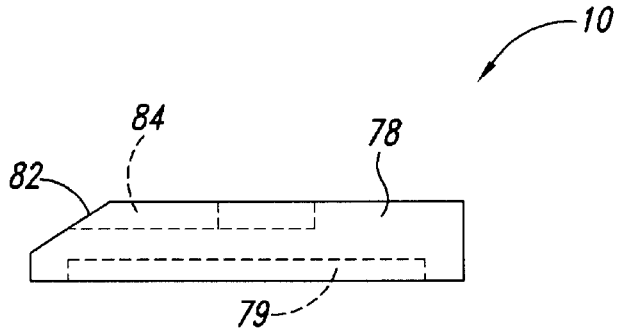
FIG. 12 is a side elevational view of the burner body of FIG. 11.
Figure 13:
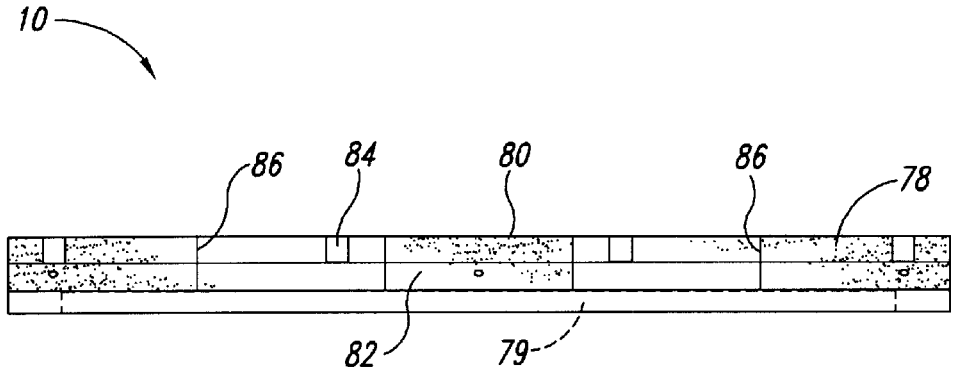
FIG. 13 is a front elevational view of the burner body of FIG. 11.
Figure 14:
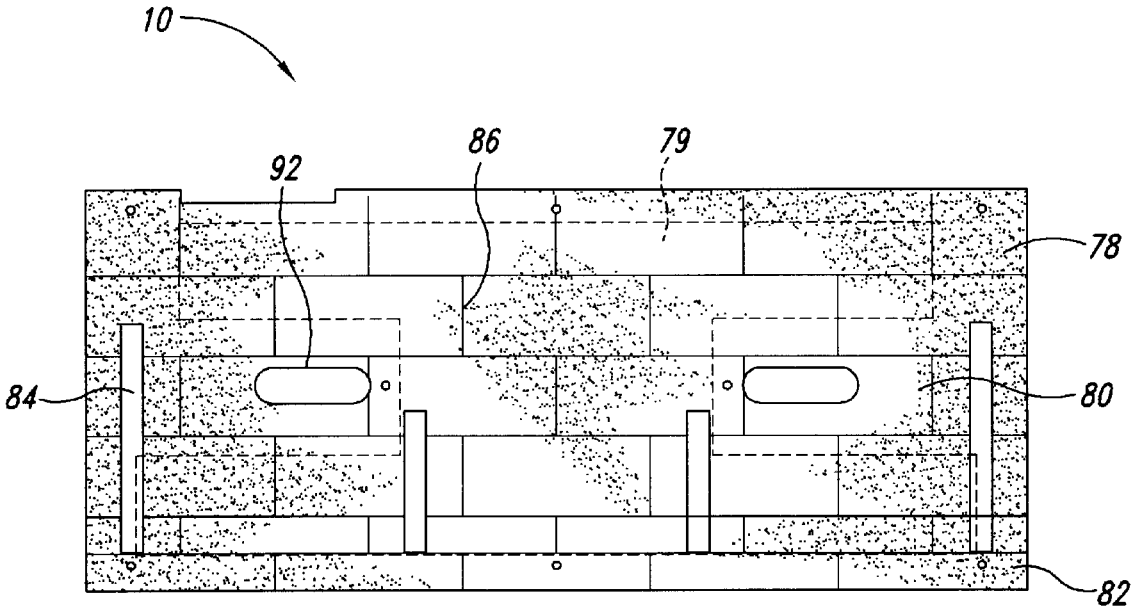
FIG. 14 is a top plan view of the burner body of FIG. 11.

As best seen in FIG. 10, the burner apertures 48 extending through the burner body 20 provide a gas passageway from the interior chamber 21 to the contoured upper surface 17. The burner apertures 48 have openings in the contoured upper surface 17 at selected locations in the peaks 62, valleys 64, or along a portion between peaks and valleys. Accordingly, the burner apertures 48 have different heights and distribute the fuel gas to different portions of the contoured upper surface 17 for combustion. The burner apertures 48 are also positioned relative to each other so that some burner apertures are grouped closer together and some burner apertures are more spread out from each other. This positioning of the burner apertures 48 helps control the distribution of the fuel gas at the contoured upper surface 17, thereby controlling the flame characteristics from the burner assembly 10. The burner apertures 48 also have selected diameters to control the volume and velocity of the fuel gas exiting the apertures at the contoured upper surface 17, thereby also controlling the fuel gas distribution and resulting flame characteristics when the burner assembly 10 is in use. As an example, the gas apertures 48 in the illustrated embodiment have diameters of approximately ⅛ inch. Other embodiments, however, can have the gas apertures with diameters larger or smaller than ⅛ inch.

In the illustrated embodiment, the burner apertures 48 are positioned so the simulated ember members 66 are heated by the flames when the burning assembly is in use, and the ceramic-based ember members glow an orange-ish color very similar to the color of burning embers in a natural wood-burning fire. The burning gas, when combined with the ceramic-based simulated ember members 66, provides flames having an orange-ish color very similar to the flames in a natural wood-burning fire. Further, the flames are caused to flicker and "dance" over the burner body's contoured upper surface 17 and about the simulated logs 16 (FIG. 1) in a manner that very closely resembles a natural wood-burning fire.

In an alternate embodiment illustrated in FIGS. 11–14, the burner assembly 10 has a burner body 78, a DVL ceramic-based material molded so the burner body has an interior chamber 79 formed therein, as discussed above, and a generally flat upper surface 80. The flat upper surface 80 provides a support area that supports a stack of simulated logs (not shown). The flat upper surface 80 also provides a clean looking support area under the log stack that resembles a clean fireplace area without a bed of embers under the logs. This clean, ember-free appearance in a fireplace is a look highly desired by some people. The burner body 78 also has a beveled front edge 82 that provides a very clean looking burner assembly 10 when combined with the stack of simulated logs.

The burner body 78 of this alternate embodiment includes a plurality of alignment channels 84 formed in the flat upper surface 80. The alignment channels extend from the beveled front edge 82 to an intermediate portion of the burner body. The channels 84 are shaped and sized to removably receive guide members of, as an example, a simulated log stack or a log rack to help position the simulated logs or rack on the flat upper surface 80.

In one embodiment, the flat upper surface 80 also includes a plurality of shallow grooves 86 so as to provide a selected contour on the burner body's upper surface 80 below the simulated log stack. In one embodiment, the shallow grooves 86 form a design resembling a plurality of bricks. When a fire is burning on the burner body 78 around the simulated logs, the flames flicker and "dance" upwardly from the burner body's flat upper surface 80 and around the simulated log stack in a manner and with colorations similar to that of a natural wood-burning fire.

Figure 15:
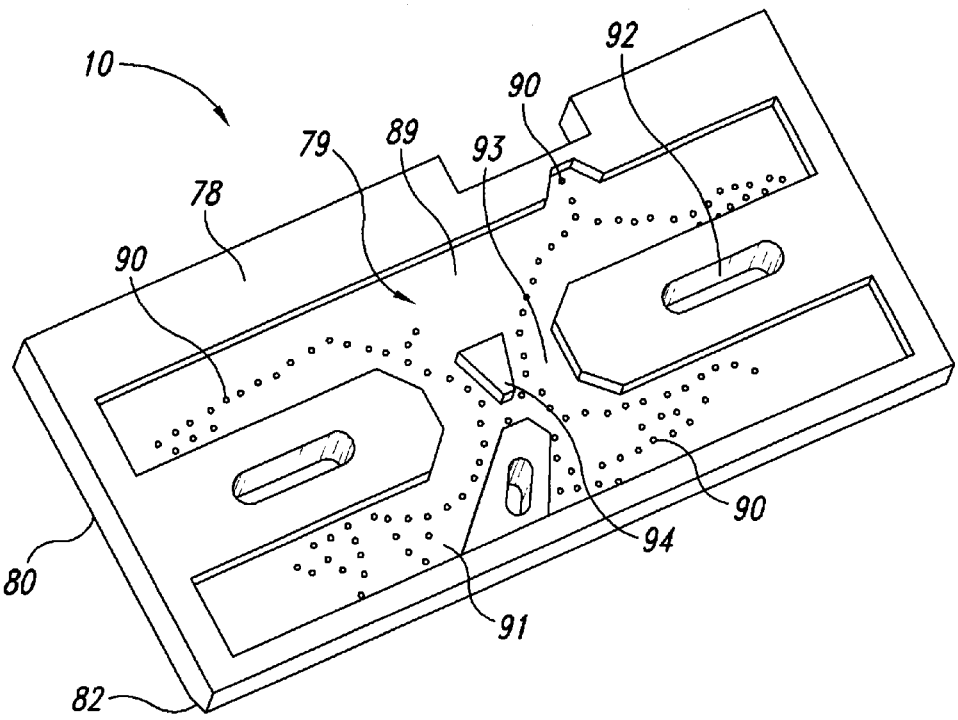
FIG. 15 is an enlarged bottom isometric view of the burner body of FIG. 11.
Figure 16:
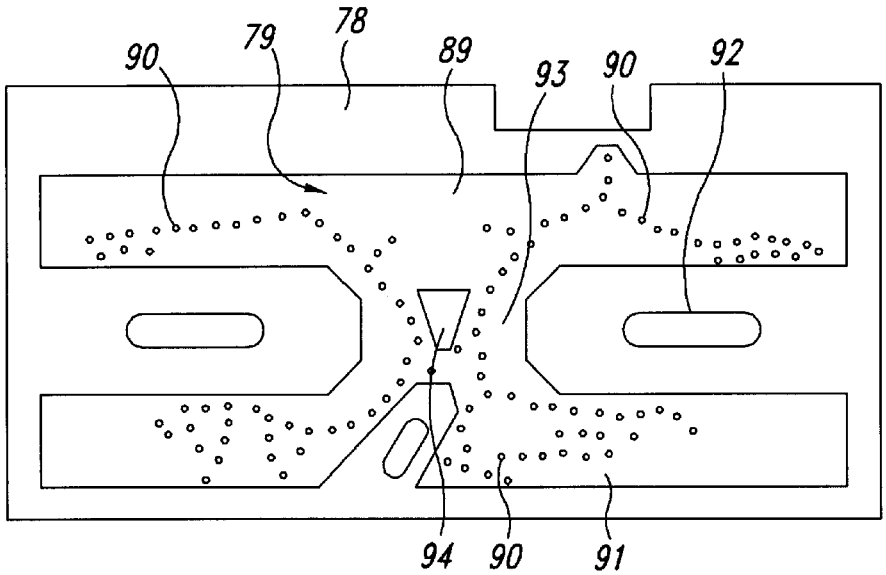
FIG. 16 is an enlarged bottom plan view of the burner body of FIG. 11.

As best seen in FIGS. 15 and 16, the interior chamber 79 of the burner body 78 has a modified "H" shape formed by enlarged front and rear chamber portions 89 and 91 and a narrow intermediate chamber portion 93 extending therebetween. A plurality of gas apertures 90 extend through the burner body 78 between the interior chamber 79 and the flat upper surface 80. The gas apertures 90 are not shown in FIGS. 11–14 for purposes of clarity. The gas apertures 90 are sized and positioned to provide the fuel gas to selected areas of the burner body's upper surface 80 to create a selected flame pattern when the burner assembly 10 is in use. In this alternate embodiment, the gas apertures 90 have substantially the same height.

The burner body 78 also includes a plurality of combustion air apertures 92 extending therethrough and spaced apart from the interior chamber 79. The burner pan 26 illustrated in FIG. 4 is connected to the burner body 78 with the gasket 28 therebetween, as discussed above, so as to form a seal around the interior chamber 79. The combustion air apertures 92 are provided so air can pass through the burner body 78 to the burner body's upper surface 80 for combustion with the fuel gas.

The burner body 78 also includes an orifice member 94 in the intermediate chamber portion 93 so as to control distribution of the fuel gas from the front chamber portion 89 to the rear chamber portion 91. Accordingly, the orifice member 94 effects the volume and rate of gas flow through the selected burner apertures, thereby controlling the flame configuration at the upper surface 80 of the burner body 78 located at the front, rear, and intermediate chamber portions 89, 91 and 93.

Figure 17:
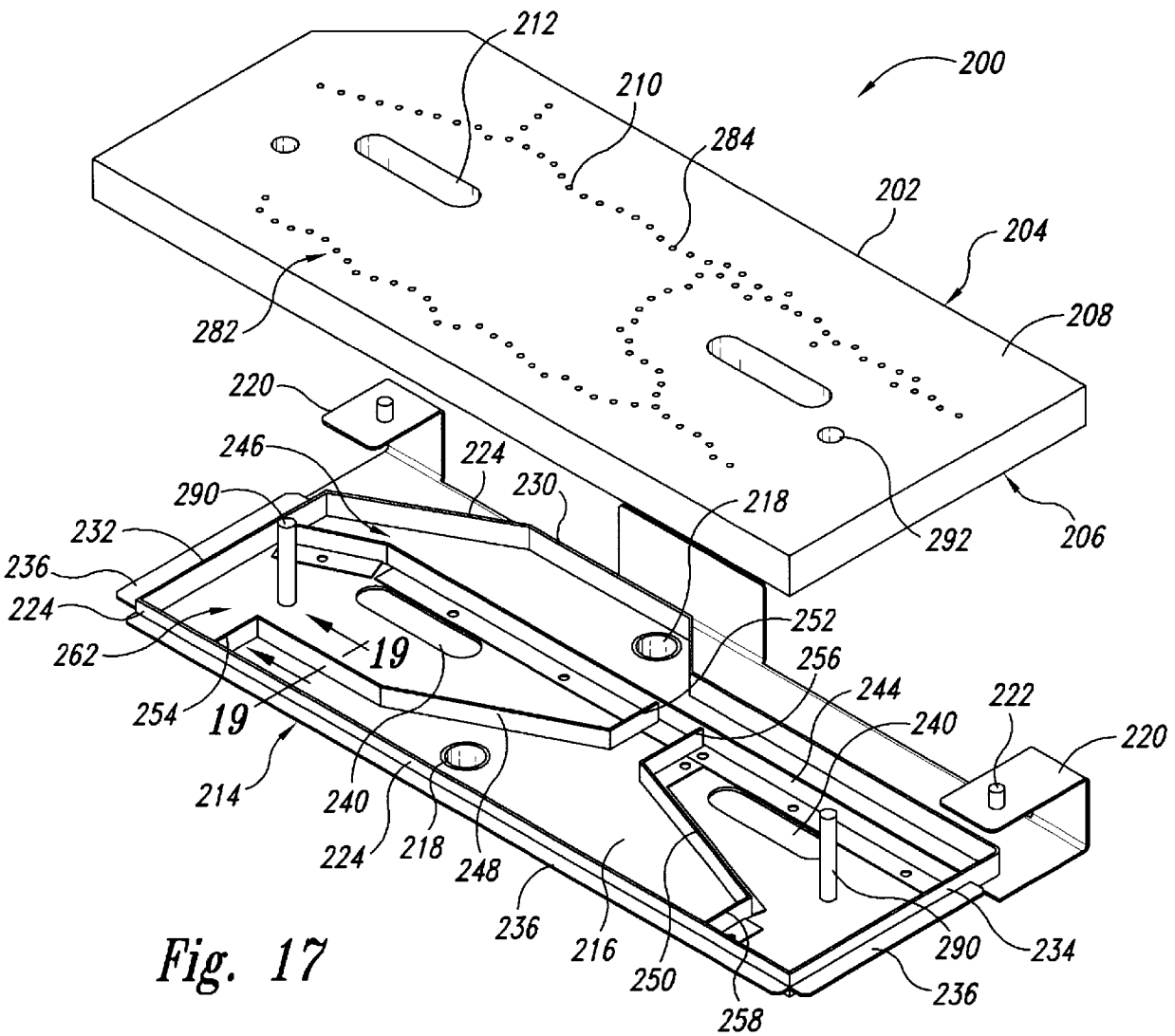
FIG. 17 is a partially exploded isometric view of a burner assembly in accordance with an alternate embodiment of the present invention, wherein a burner body is shown spaced apart from a burner pan.

FIG. 17 is a partially exploded isometric view of a burner assembly 200 in accordance with an alternate embodiment of the present invention. The burner assembly 200 includes a non-metallic burner body 202 with an upper portion 204 and a lower portion 206. The upper portion 204 includes an upper surface 208 that has a selected contour to provide an appearance of, for example, the simulated coal bed or the simulated fireplace bricks discussed above. Other embodiments can have other contoured upper surface designs.

The burner body 202 includes a plurality of burner apertures 210 extending therethrough between the upper and lower portions 204 and 206. The burner apertures 210 are similar to those discussed above and are provided in a selected pattern on the burner body 202 for the desired gas distribution pattern over the burner body's upper surface 208. The burner body 202 also includes a pair of elongated combustion air holes 212 through which combustion air is provided to the upper surface 208 for burning of the fuel gas.

The burner assembly 200 has a burner pan 214 that connects to the burner body's lower portion 206. The burner body 202 and the burner pan 214 are secured together (discussed in greater detail below) and mount to a retention bracket 220. In the illustrated embodiment, the retention bracket 220 is configured for use within the gas fireplace, insert, or stove to securely hold the burner assembly 200 in a selected position within the firebox (not shown). The illustrated retention bracket 220 includes a pair of mounting pins 222 that can be used to secure a simulated log stack or the like.

Figure 18:
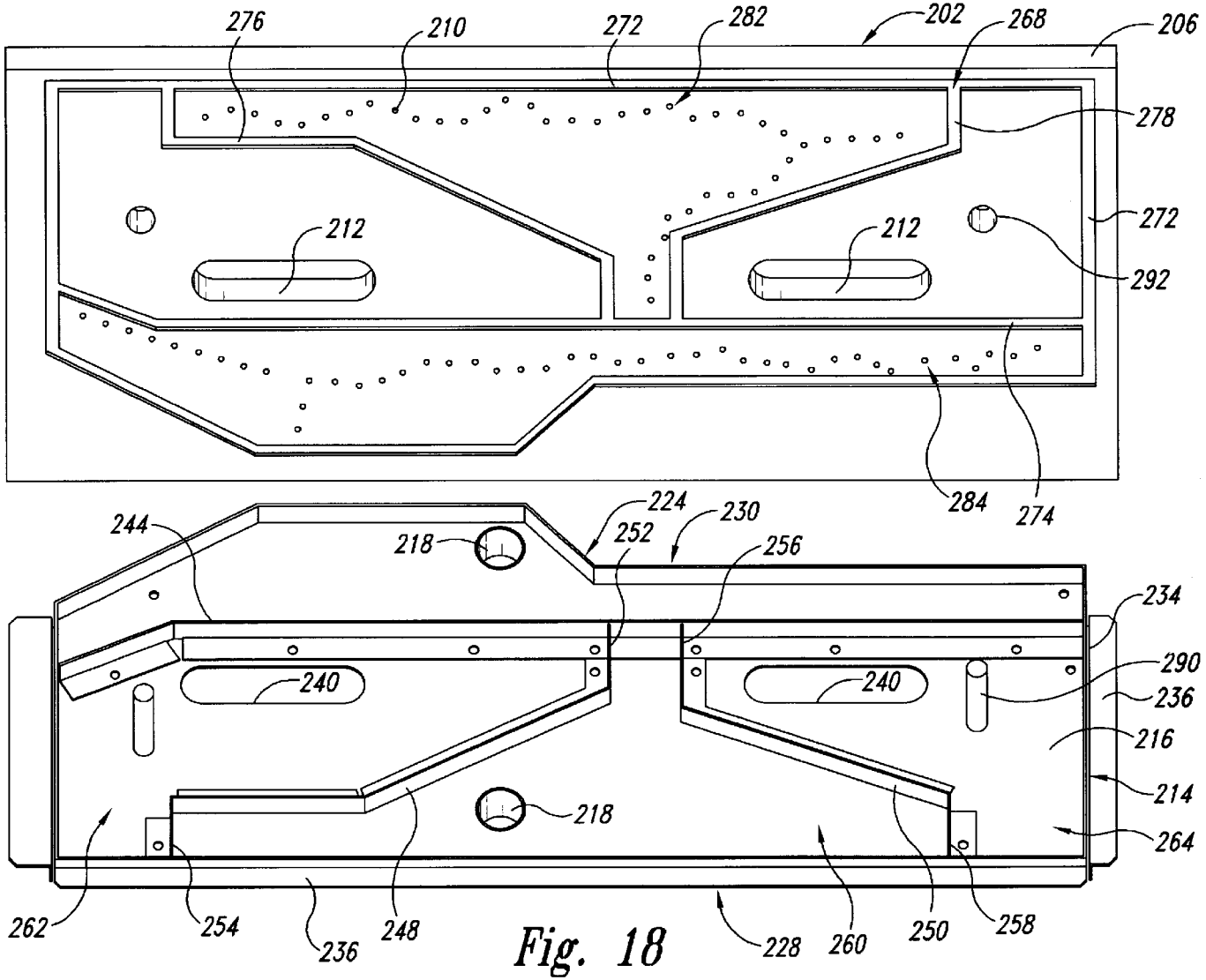
FIG. 18 is a partially exploded perspective view of the burner pan and the burner body of FIG. 17, the burner body being shown rotated relative to the burner pan to simultaneously show the burner pan and a lower portion of the burner body.

FIG. 18 is a partially exploded perspective view of the burner pan 214 and the burner body 202, the burner body being shown rotated relative to the burner pan to simultaneously show the burner pan and a lower portion of the burner body. The burner pan 214 has a shallow pan configuration formed by a base 216 and a plurality of perimeter fences 224 connected to the perimeter of the base 216 and projecting upwardly away from the base. The base 216 has a pair of gas inlet apertures 218 extending therethrough. The gas inlet apertures 218 are connected to a mixing tube assembly (not shown), which is coupled to a gas source. Accordingly, the fuel gas is provided into the burner assembly 200 through these two gas inlet apertures.

The illustrated perimeter fences 224 form sidewalls that are integrally connected to the base 216. In alternate embodiments, the perimeter fences 224 can be separate structures securely attached to the base 216. The base 216 and perimeter fences 224 are configured such that, when the burner body 202 is positioned on the burner pan 214, an interior gas distribution chamber 226 is formed between the burner body, the perimeter fences, and the base. The interior gas distribution chamber 226 receives fuel gas through the gas inlet apertures 218 and provides the fuel gas to the burner body's upper surface 208 through the burner apertures 210 extending through the burner body 202.

The burner pan 214, as oriented in FIG. 18, has a front side 228 shown closer to the bottom of the drawing page, a rear side 230 closer to the top of the drawing page, a left side 232, and a right side 234. The burner pan 214 has side support plates 236 projecting outwardly away from the perimeter fences 224 on the front, left, and right sides 228, 232, and 234. The support plates 236 are positioned to engage and support the lower portion 206 of the burner body 202 when the burner body is joined with the burner pan 214 to help support the burner body.

The burner pan 214 also has a plurality of chamber fences 224 connected to the base 216 and projecting upwardly toward the burner body 202. The chamber fences 224 include a rear fence 244 that extends across the length of the base 216 between the burner pan's left and right sides 232 and 234. The rear fence 244 in the illustrated embodiment abuts the perimeter fence 224 on the burner pan's left side 232 and abuts the perimeter fence on the burner pan's right side 234. The rear fence 244 is positioned rearward of a pair of elongated combustion air holes 240 formed in the burner pan's base 216. The rear fence 244 is also spaced forward of the perimeter fence 224 on the burner pan's rear side 230. Accordingly, the rear fence 244 is spaced apart from the perimeter fence 224 so as to form a rear chamber portion 246 of the interior gas distribution chamber 226.

The rear chamber portion 246 is in fluid communication with the rear gas inlet aperture 218 such that gas flowing therethrough will flow into the rear chamber portion. The rear fence 244 is positioned to block the fuel gas from flowing forwardly out of the rear chamber portion 246 when the burner body 202 is attached to the burner pan 214, discussed in greater detail below.

The chamber fences 242 also include a left fence 248 and a right fence 250. The left fence 248 has a rearward end 252 that abuts a middle portion of the rear fence 244, and a forward end 254 that abuts the perimeter fence 224 on the burner pan's front side 228. The right fence 250 has a rearward end 256 that abuts a middle portion of the rear fence 244 and a forward end 258 that abuts the perimeter fence 224 on the burner pan's front side 228. The left and right fences 248 and 250, a portion of the rear fence 244 and a portion of the perimeter fence 224 on the burner pan's front side 228 are positioned in the interior gas distribution chamber 226 to define a front chamber portion 260. This front chamber portion 260 is in fluid communication with the forward gas inlet aperture 218 so as to receive fuel gas from the gas source through the gas inlet aperture. Accordingly, the chamber fences 242 and perimeter fences 224 are configured to divide the gas distribution chamber 226 into the front and rear chamber portions 246 and 260 for selective distribution of the fuel gas through the burner body 202.

The left fence 248 and the left side of the rear fence 244 also combine with the perimeter fence 224 to form a left combustion air chamber 262 that receives combustion air through the combustion air hole 240 on the left side of the burner pan's base 216. The right fence 250 combines with the right side of the rear fence 244 and the perimeter fence 224 to form a right combustion air chamber 264 that receives combustion air through the combustion air hole 240 on the right side of the burner pan's base 216. The left and right combustion air chambers 262 and 264 each communicate with the combustion air apertures 212 in the burner body 202 to provide the combustion air to the upper surface 208 for ignition of the fuel gas.

As best seen in FIG. 18, the lower portion 206 of the burner body 202 has a plurality of shallow channels 268 formed therein shaped and sized to receive the chamber fences 242 and perimeter fences 224 of the burner pan 214. The channels 268 include a perimeter channel 272 that has the same shape and orientation as the perimeter fences 224 of the burner pan 214. The channels 268 also include a rear-fence channel 274, a left-fence channel 276, and right-fence channel 278. The rear-fence channel 274 extends between the left and right sides of the perimeter channel 272. The left-fence channel 276 extends between the rear side of the perimeter channel 272 and the rear-fence channel 274. The right-fence channel 278 extends between the rear side of the perimeter channel 272 and the rear-fence channel 274.

The perimeter channel 272, the rear-fence channel 274, the left-fence channel 276, and the right-fence channel 278 are shaped and positioned to receive the respective perimeter fence 224 and chamber fences 242 so as to provide the sealed front and rear chamber portion 260 and 246 between the burner body 202 and the burner pan's base 216. This interconnection between the burner body 220 and the burner pan's perimeter fence 224 and the chamber fences 242 also forms the sealed left and right combustion air chambers 262 and 264 to prevent cross contamination of combustion air with the fuel gas before the fuel gas passes through the burner apertures 210 in the burner body 202. In the illustrated embodiment, the burner body 220 and the burner pan 214 are held together with an adhesive in the channels 268 that bonds with the perimeter fences 224 and the chamber fences 264.

The burner apertures 210 in the illustrated embodiment are arranged to provide a forward aperture set 282 that communicates directly with the front gas chamber portion 260. The fuel gas provided into the forward gas chamber portion 260 is distributed throughout the chamber portion and flows through the burner apertures 210 in this forward aperture set 282 to the burner body's upper surface 208 (FIG. 17) for ignition. The burner apertures 210 are also configured to provide a rear aperture set 284 in fluid communication with the rear gas chamber portion 246. The fuel gas from the rear chamber portion 246 flows through the burner apertures 210 in the rear aperture set 284 to the burner body's upper surface 208 (FIG. 17) for ignition.

As discussed in greater detail below, when the burner pan 214 is mounted on the burner body, the burner pan seals against the lower portion 206 of the burner body. This sealed engagement prevents cross flow or leakage of the fuel gas and the combustion air between the front and rear chamber portions 246 and 250 and the left and right combustion air chambers 262 and 264.

Figure 19:
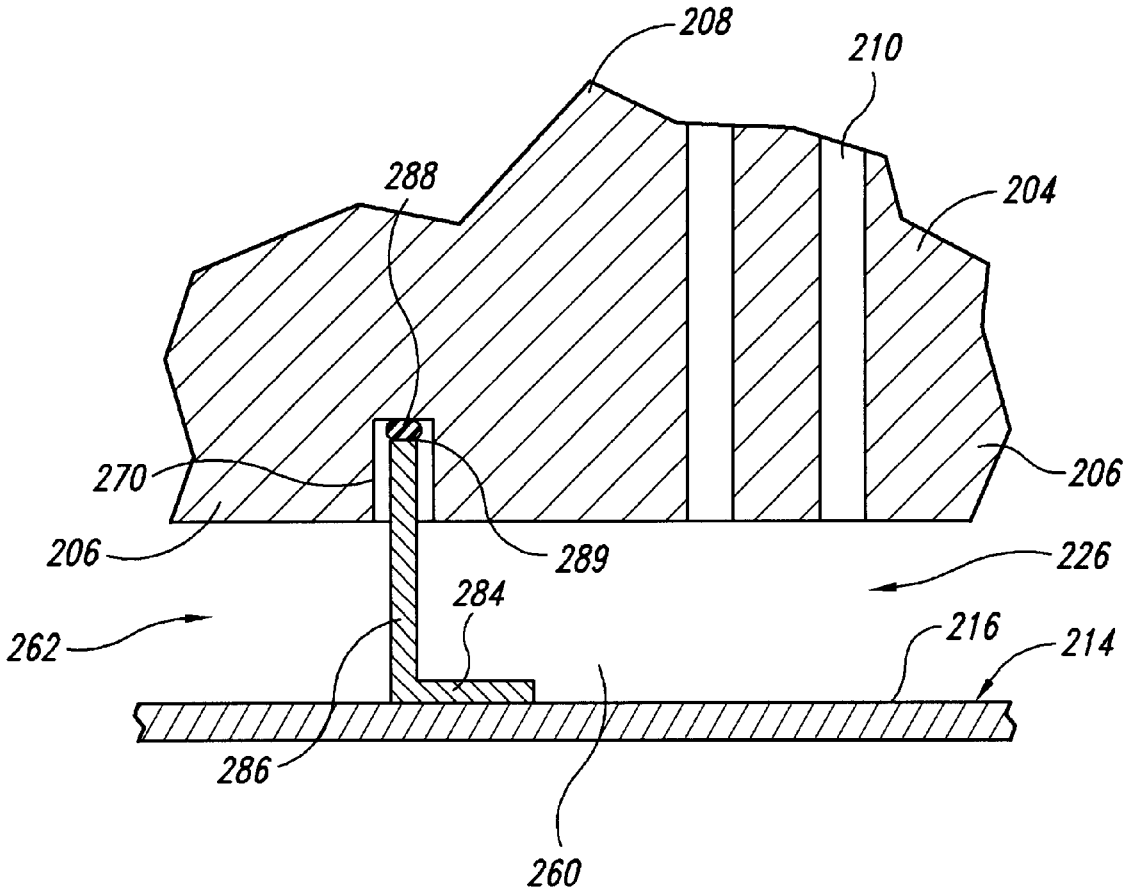
FIG. 19 is an enlarged cross-sectional view taken substantially along line 19—19 of FIG. 17 showing a portion of the burner body positioned on the burner pan.

FIG. 19 is an enlarged cross-sectional view showing a portion of the burner body positioned on the burner pan, with the left chamber fence 248 positioned in left-fence channel 276. The left chamber fence 248 is described below, although the description is applicable to the other chamber fences 224. The left chamber fence 248 has an "L" cross-sectional shape with a bottom leg 284 is spot welded or otherwise affixed to the burner pan's base 216. A vertical leg 286 extends upwardly away from the base and the bottom leg 284. The height of the vertical leg 286 is greater than the depth of the left-fence channel 276 formed in the burner body's lower portion 206. Accordingly, the fence's vertical leg 286 extends into the left-fence channel 276 and engages the burner body 202 so as to hold the bottom of the burner body apart from the burner pan's base 216. This space between the burner body 202 and the burner pan 214 form the gas distribution chamber 226. In the illustrated embodiment, a seal 288 is provided between the top edge 289 of the fence's vertical leg 286 and the burner body within the left-fence channel 276. The seal 288 prevents the cross flow of fuel gas or combustion air between the different chamber portions of the gas distribution chamber 226. In one embodiment, the seal 288 is a silicone seal. Other embodiments can use other materials for the seal such as a non-flamable sealing material. This sealing material can also be an adhesive material that forms a suitable seal.

As best seen in FIG. 17, the burner assembly 200 of the illustrated embodiment has a pair of alignment pins 290 that project upwardly away from the burner pan's base 216. The alignment pins 290 are positioned to extend through alignment apertures 292 in the burner body 202. The alignment pins 290 and alignment apertures 292 are positioned such that, when the burner body is placed onto the burner pan, the alignment pins 290 extend through the alignment apertures 292. The alignment pins 290 and accurately position the burner body 202 so the channels 270 (FIG. 18) are over the chamber fences 242 and perimeter fences 224. Accordingly, the alignment pins 290 and alignment apertures 292 allow for easy and quick alignment of the burner pan 214 onto the burner body 202.

Figure 20:
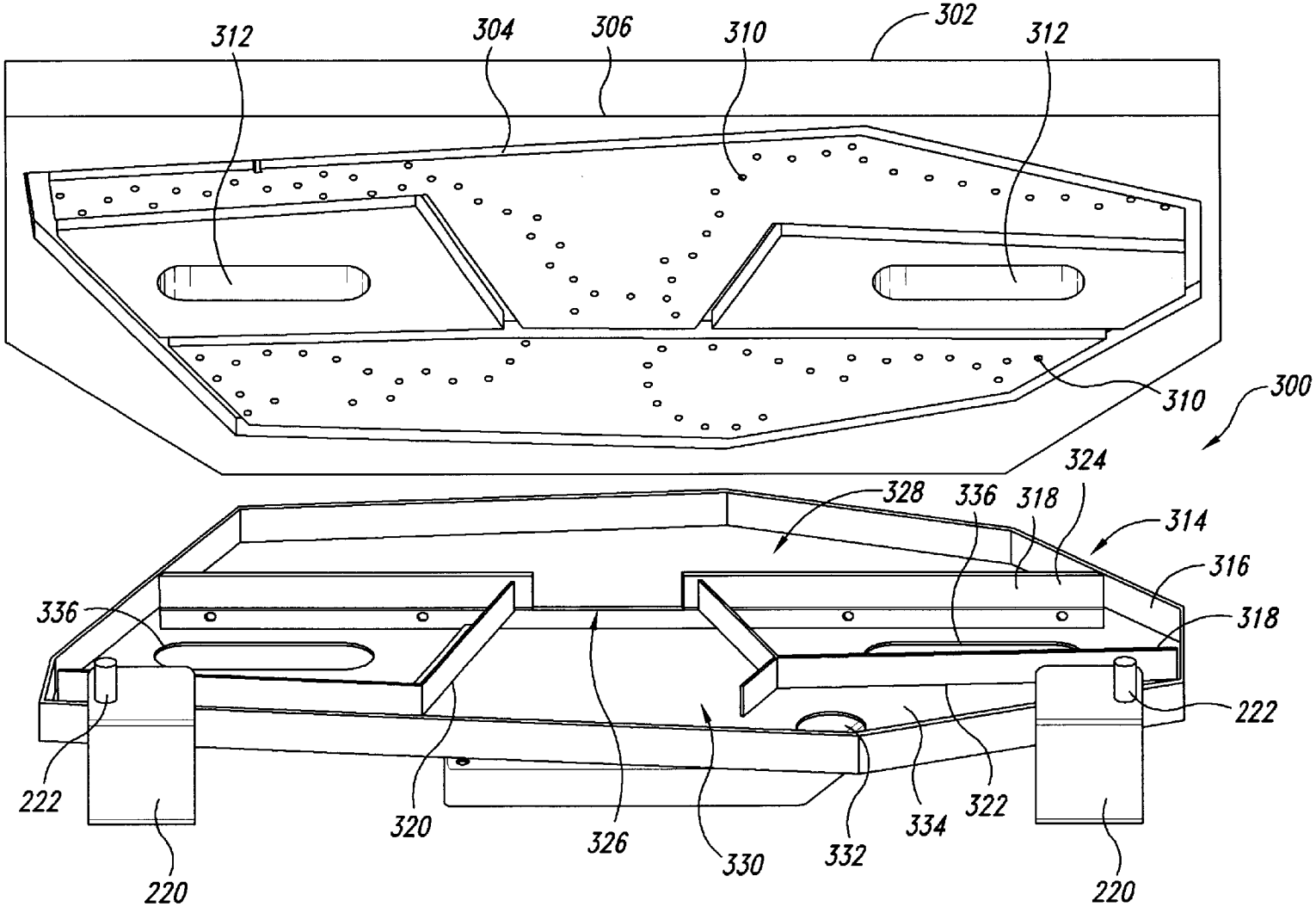
FIG. 20 is a partially exploded perspective view of a burner assembly in accordance with an alternate embodiment of the present invention, the burner body is shown rotated relative to a burner pan to simultaneously show the burner pan and a lower portion of the burner body.

FIG. 20 is a partially exploded perspective view of a burner assembly 300 in accordance with an alternate embodiment of the present invention. The burner assembly 300 is very similar to the embodiment discussed above with reference to FIGS. 17–19, so only the primary differences will be discussed in detail. The burner assembly 300 has the burner body 302 with the fence channels 304 formed in the burner body's lower portion 306. The burner body 302 also has a plurality of burner apertures 310 and a pair of combustion air holes 312 extending therethrough. The burner pan 314 of the illustrated embodiment includes the perimeter fences 316 and internal chamber fences 318. The chamber fences 318 include the left and right chamber fences 320 and 322 that abut the perimeter fence 316 and also abut a rear fence 324.

The rear fence 324 has an open space forming a flow gate 326 therein that provides for fluid communication of fuel gas between the rear distribution chamber portion 328 and the front distribution chamber portion 330. Because the flow gate 326 allows for the gas to flow between the front and rear distribution chamber portions 330 and 328, the burner pan 314 has only a single gas inlet aperture 332 formed in the burner pan's base 334. The distribution fences 318 and the perimeter fence 316 provide a sealed area around the combustion air holes 312 and 336 in the burner body 302 and the base 334, respectively, so as to prevent mixing of the combustion air with the fuel gas before the fuel gas passes through the burner aperture 310.

The shape and size of the flow gate 326 is selected in order to provide a desired distribution characteristic of the fuel gas within the gas distribution chamber so as to ensure the proper flow of the fuel gas through the burner apertures 310 in the burner body. The size of the burner apertures 310 is also selected so as to ensure a proper flow of the fuel gas to the burner body's upper surface to provide the desired flame characteristics when the gas is ignited.

Although specific embodiments of, and examples for, the present invention are described herein for illustrative purposes, various equivalent modifications can be made without departing from the spirit and scope of the invention, as will be recognized by those skilled in the relevant art. These and other changes can be made to the invention in light of the above detailed description. In general, in the following claims, the terms used should not be construed to limit the invention to the specific embodiments disclosed in the specification and the claims, but should be construed to include all burner assemblies that operate in accordance with the claims.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A burner assembly for burning a fuel gas from a gas source, comprising:

a burner pan with a fuel gas inlet aperture therein; and a burner body having upper and lower portions, the lower portion of the burner body being sealably connected to the burner pan forming an interior gas distribution chamber therebetween, the interior gas distribution chamber positioned to receive a flow of fuel gas therein from the fuel gas inlet aperture, the interior gas distribution chamber having a gas flow orifice member positioned between a first chamber portion and a second chamber portion to selectively control the flow of the fuel gas from the first chamber portion to the second chamber portion, the upper portion of the burner body having a contoured surface with a plurality of peaks and valleys to form a plurality of simulated coal members, the upper portion of the burner body having a plurality of gas distribution apertures extending from the interior gas distribution chamber to the contoured surface, the plurality of gas distribution apertures being positioned to direct a flow of the fuel gas from the interior gas distribution chamber to the contoured surface for ignition, the burner body being constructed of a material that glows at selected color variations in the simulated coal members to simulate a burning and glowing coal ember bed in the base of a fire when the fuel gas is ignited adjacent to the contoured surface.

2. The burner assembly of claim 1 wherein the interior gas distribution chamber has a plurality of chamber portions to maintain a desired fuel gas pressure within the interior gas distribution chamber.

3. The burner assembly of claim 1 wherein the plurality of gas distribution apertures have open upper ends positioned in a plurality of different planes so the open upper ends are not co-planar thereby controlling the distribution of the fuel gas at the contoured surface of the upper portion of the burner body.

4. The burner assembly of claim 1 wherein a selected group of the plurality of gas distribution apertures are concentrated relative to each other to provide a selected flame shape when the fuel gas flowing through the concentrated group of gas distribution apertures is ignited adjacent to the upper portion of the burner body.

5. The burner assembly of claim 1 wherein the burner body includes a combustion air hole extending therethrough, the combustion air hole being out of fluid communication with the interior gas distribution chamber.

6. The burner assembly of claim 1 wherein the plurality of gas apertures have substantially the same height.

7. The burner assembly of claim 1 wherein the gas distribution apertures have a plurality of diameters selectively sized to control a flow of the fuel gas therethrough.

8. The burner assembly of claim 1, further comprising a gasket sandwiched between the burner pan and the burner body.

9. The burner assembly of claim 1 wherein the contoured surface provides a non-uniform surface that provides simulated coal portions of different sizes and heights.

10. The burner assembly of claim 1 wherein the upper portion of the burner body has a simulated-log-support surface and a plurality of guide members positioned to removably receive simulated logs thereon.

11. The burner assembly of claim 1 wherein the burner body is constructed of a ceramic-based material.

12. The burner assembly of claim 1 wherein the burner body is constructed of compressed vermiculite.

13. A burner assembly for burning a fuel gas from a gas source, comprising:

a burner pan with a fuel gas inlet aperture therein; and a burner body having upper and lower portions, the lower portion of the burner body being sealably connected to the burner pan forming an interior gas distribution chamber therebetween, the interior gas distribution chamber positioned to receive a flow of fuel gas therein from the fuel gas inlet aperture, the upper portion of the burner body having a contoured surface with a plurality of peaks and valleys to form a plurality of simulated coal members, the upper portion of the burner body having a plurality of gas distribution apertures extending from the interior gas distribution chamber to the contoured surface, the plurality of gas distribution apertures being positioned to direct a flow of the fuel gas from the interior gas distribution chamber to the contoured surface for ignition, the burner body being constructed of a material that glows at selected color variations in the simulated coal members to simulate a burning and glowing coal ember bed in the base of a fire when the fuel gas is ignited adjacent to the contoured surface, wherein the burner pan has a base spaced apart from the burner body and a plurality of distribution fences projecting from the base, the lower portion of the burner body has a plurality of channels that receive a portion of the distribution fences, the distribution fences dividing the interior gas distribution chamber into separate chamber portions for distribution of the fuel gas to selected ones of the gas distribution apertures.

14. The burner assembly of claim 4 wherein the fences sealably engage the burner body in the channels.

15. A burner assembly for burning a fuel gas from a gas source, the burner assembly being connectable to a burner pan with a gas inlet aperture therein, the burner pan having a base and a projection extending away from the base, comprising:

a burner body having upper and lower portions, the lower portion of the burner body being releasably connectable to the burner pan in a position to form a gas distribution chamber therebetween in fluid communication with the gas inlet aperture, the upper portion of the burner body having a contoured surface with a plurality of peaks and valleys, the burner body having a plurality of gas distribution apertures extending from the lower portion to the contoured surface, the plurality of gas distribution apertures being positioned to direct a flow of the fuel gas to the contoured upper surface for ignition, the lower portion of the burner body having an elongated channel therein sized to receive the projection therein when the burner pan is connected to the burner body, the channel being positioned to define at least a portion of the gas distribution chamber for distribution of the fuel gas to the gas distribution apertures.

16. The burner assembly of claim 15 wherein the contoured surface is shaped to form a plurality of simulated coal members in a simulated ember bed.

17. The burner assembly of claim 16 wherein the burner body is constructed of a material that glows at selected color variations in the simulated coal members to simulate a burning and glowing coal ember bed in the base of a fire when the fuel gas is ignited adjacent to the contoured surface.

18. The burner assembly of claim 15 wherein the contoured surface is shaped to form a plurality of simulated bricks.

19. The burner assembly of claim 15 wherein the plurality of gas apertures have open upper ends positioned in a plurality of different planes, so the open upper ends are not co-planar.

20. A burner assembly for burning a fuel gas from a gas source, comprising:

a burner pan with a base having a fuel gas inlet aperture therein, and a distribution fence attached to the base of the burner pan, the distribution fence projecting away from the base; and a burner body having upper and lower portions, the burner body being connected to the burner pan integrally forming an interior gas distribution chamber therebetween, the lower portion of the burner body having a channel formed therein and at least a portion the distribution fence of the burner pan is positioned within the channel, the interior gas distribution chamber having a plurality of chamber portions being positioned to receive a flow of the fuel gas therein from at least one fuel gas inlet aperture, the upper portion of the burner body having a contoured surface with a plurality of peaks and valleys the burner body having a plurality of gas distribution apertures extending therethrough from the lower portion to the contoured surface of the upper portion, the plurality of gas distribution apertures being positioned to direct a flow of the fuel gas to the contoured surface of the upper portion of the burner body for ignition, the burner body being constructed of a non-metallic material that glows at selected color variations when the fuel gas is ignited adjacent to the contoured surface.

21. The burner assembly of claim 20 wherein the peaks and valleys in the contoured surface is shaped to form a plurality of simulated coal members.

22. The burner assembly of claim 20 further comprising a seal in the channel of the burner body positioned to sealably engage the distribution fence of the burner pan.

23. The burner assembly of claim 20 wherein the height of the channel is less than the height of the distribution fence to create the interior gas distribution chamber.

24. The burner assembly of claim 20 wherein the distribution fence is positioned to divide the gas distribution chamber into a first portion and a second portion, the distribution fence having a passage therein to provide for fluid communication between the first and second portions of the gas distribution chamber.

25. The burner assembly of claim 20 further comprising the burner pan with a perimeter fence to define the gas distribution chamber and a plurality of interior fences to divide the gas distribution chamber.

26. A burner assembly for burning a fuel gas from a gas source, comprising:

a burner pan with a base having a fuel gas inlet aperture therein, and a distribution fence attached to the base of the burner pan, the distribution fence projecting away from the base; and a burner body having upper and lower portions, the burner body being connected to the burner pan integrally forming an interior gas distribution chamber therebetween, the burner pan having a plurality of distribution fences positioned to form separate chamber portions of the interior gas distribution chamber, the interior gas distribution chamber having a plurality of chamber portions being positioned to receive a flow of the fuel gas therein from at least one fuel gas inlet aperture, the upper portion of the burner body having a contoured surface with a plurality of peaks and valleys the burner body having a plurality of gas distribution apertures extending therethrough from the lower portion to the contoured surface of the upper portion, the plurality of gas distribution apertures being positioned to direct a flow of the fuel gas to the contoured surface of the upper portion of the burner body for ignition, the burner body being constructed of a non-metallic material that glows at selected color variations when the fuel gas is ignited adjacent to the contoured surface, the fuel gas inlet aperture is a first fuel gas inlet aperture, the base of the burner pan having a second fuel gas inlet aperture, the plurality of distribution fences being positioned to define first and second portions of the gas distribution chamber out of fluid communication with each other wherein the first portion communicates with the first gas inlet aperture and the second portion communicates with the second gas inlet aperture.

27. A burner assembly for burning a fuel gas from a gas source, the burner assembly being connectable to a burner pan with a fuel gas inlet aperture therein, coupleable to the gas source, comprising:

a non-metallic burner body having upper and lower portions, the burner body being removably connectable to the burner pan to form an interior gas distribution chamber, the interior gas distribution chamber having a first chamber portion positioned to receive a flow of the fuel gas therein from the fuel gas inlet aperture and having a second chamber portion in fluid connection with the first chamber portion, a gas flow orifice member being positioned between the first and second chamber portions to selectively control the flow of the fuel gas from the first chamber portion or to the second chamber portion, the upper portion of the burner body having a contoured surface with a plurality of peaks and valleys to form a plurality of simulated coal members, and the contoured surface forming a simulated-log-support surface and a plurality of guide members positioned to removably receive the simulated log members, the upper portion of the burner body having a plurality of gas distribution apertures extending from the interior gas distribution chamber to the contoured surface, a first portion of the plurality of gas apertures terminating at the contoured surface in the valleys, and a second portion of the plurality of gas distribution apertures terminating at the contoured surface at the peaks with the plurality of gas distribution apertures having different heights, the plurality of gas distribution apertures being positioned to direct a flow of the fuel gas to the contoured surface of the upper portion of the burner body for ignition, the non-metallic burner body being constructed of a material that glows at selected color variations in the simulated coal members to simulate a burning and glowing coal ember bed in the base of a fire when the fuel gas is ignited adjacent to the contoured surface.

28. The burner assembly of claim 27 wherein the burner body is constructed of a ceramic-based material.

29. The burner assembly of claim 27 wherein the burner body is constructed of compressed vermiculite.

30. The burner assembly of claim 27 wherein the burner body includes a combustion air hole extending therethrough, the combustion air hole positioned to be out of fluid communication with the gas distribution chamber when the burner pan is connected to the burner body.

31. The burner assembly of claim 27 wherein the gas distribution apertures have a plurality of different diameters selectively sized to control a flow of the fuel gas therethrough.

32. The burner assembly of claim 27 wherein the first chamber portion is larger than the second chamber portion and a greater number of gas distribution apertures communicate with the first chamber portion then the number of gas distribution apertures in direct fluid communication with the second chamber portion.

* * * * *

UNITED STATES PATENT AND TRADEMARK OFFICE

CERTIFICATE OF CORRECTION

PATENT NO. : 6,443,726 B2 
DATED : September 3, 2002
INVENTOR(S) : Alan R. Atemboski, Leslie E. King and Kurt W. F. Rumens It is certified that error appears in the above-identified patent and that said Letters Patent is hereby corrected as shown below:

Column 12,
Line 55, "claim 4" should be -- claim 13 --.

Signed and Sealed this

Thirteenth Day of April, 2004

JON W. DUDAS
*Acting Director of the United States Patent and Trademark Office*